US005084973A

United States Patent [19]

Geer

[11] Patent Number: 5,084,973

[45] Date of Patent: Feb. 4, 1992

[54] ADJUSTABLE SPACER FOR HAIR CLIPPERS

[76] Inventor: Frederick J. Geer, 1045 Kentwood Cir., Charleston, S.C. 29412

[21] Appl. No.: 479,429

[22] Filed: Feb. 14, 1990

[51] Int. Cl.[5] ..... B26B 19/20; B26B 19/44

[52] U.S. Cl. ..... 30/133; 30/201

[58] Field of Search ..... 30/133, 195, 200, 201; 403/328

[56] References Cited

U.S. PATENT DOCUMENTS

| | | | |
|---|---|---|---|
| 1,446,559 | 2/1923 | Gray | 403/328 |
| 1,695,009 | 12/1928 | Cochran | 403/328 |
| 2,802,263 | 8/1957 | Marchner | 30/201 |
| 2,941,293 | 6/1960 | Mazzoni | 30/201 |
| 3,237,304 | 2/1965 | Merzon | 30/201 |
| 3,262,200 | 7/1966 | Suozzi | 30/201 |
| 3,272,209 | 9/1966 | Kraus | 30/201 X |
| 3,413,718 | 12/1968 | Baumann | 30/201 X |
| 3,900,949 | 8/1975 | Anzalone | 30/201 X |
| 3,979,825 | 9/1976 | Baumann | 30/201 X |
| 4,669,189 | 6/1987 | Ullmann | 30/201 |

*Primary Examiner*—Frank T. Yost
*Assistant Examiner*—Kenneth E. Peterson

[57] ABSTRACT

An adjustable spacer for extending away from the scalp conventional powered hair clippers adapted for pneumatic removal of hair cuttings to predetermine the length of cut hair, which spacer provides extension members on either of opposing sides of the cutting head of the clippers by attachment thereto of a bracket. The degree of extension of the spacer from the bracket is determined by regulation of the opposing extension members. The spacer may be attached directly to the clippers, or, in the alternative, may be attached to a conventional shoe comb which, in turn, may be easily attached to and detached from the clippers.

9 Claims, 1 Drawing Sheet

ADJUSTABLE SPACER FOR HAIR CLIPPERS

BACKGROUND OF THE INVENTION (1) Field of the Invention

This invention relates generally to hair cutting devices or razors. More particularly, this invention relates to adjustable spacers for powered hair clippers to permit multiple shearing positions using a single cutting instrument. Specifically, this invention relates to an element, easily attachable/detachable to hair clippers, to serve as a spacing means to selectively locate the clippers relative to the subject's scalp for predetermining the length of cut hair. The spacer element is designed and constructed to enable one not trained in the cutting of hair to accurately cut hair in the comfort of one's home with minimal equipment.

(2) Description of the Prior Art

While the use of electric hair cutters and pneumatic removal of hair cuttings are well known, such devices have been adapted primarily for shaving and close cropping of hair and incapable of cutting, trimming, or styling of hair of substantial length (i.e., on the order of several inches).

U.S. Pat. Des. No(s). 175,141 and 185,170 disclose hair clipper comb plate attachments which permit variable spacing of the clippers from the subject's head. U.S. Pat. No. Des. 257,690 discloses a hair grooming attachment affixed onto the hair clipper. These designs, however, do not permit the degree of spacing variability as does the present invention.

U.S. Pat. No. 2,941,293 discloses a motor-driven, self-operated hair clipper with an adjustable length-of-cut guide. This hair clipper operates without a pneumatic aid to lift the hair from the scalp and is limited to cutting hair to relatively short lengths as compared to many modern hair styles. U.S. Pat. No. 3,138,870 describes a vacuum operated hair clipper wherein the air movement created by the vacuum operates a turbine connected to the cutting mechanism in addition to removing the cut hair. U.S. Pat. No. 3,272,209 teaches the combination of a hair cutter and a head mounted guide. The head mounted cutter guide is a cumbersome cage-like device, unnecessary to the herein claimed invention. Also, the patentees make no provision for lifting the hair from the scalp to assure regulated cutting length.

U.S. Pat. No. 3,648,370 discloses a tapering shoe comb adapted for use in detachable connection with a hair clipper. The detachable comb permits a plurality of positions of adjustment to accommodate a wide range of selected lengths of hair. In particular, a hand adjustment wheel on the outside of the shoe comb is graduated so that a hair stylist can adjust the position of the comb to a predetermined position. The detachable comb is limited, however, to uniform adjustment across its width and still requires a stylist's skill to achieve a proper tapering effect.

U.S. Pat. No. 3,900,949 discloses a power hair cutter with a hollow open-ended enclosure including hair movement means for drawing a subject's hair therein where a cutter severs the hair and the hair movement means simultaneously removes the hair cuttings. There is attached to the hollow enclosure movable spacer means for selectively locating the cutting apparatus relative to the subject's head for predetermining the length of cut hair. This spacer means includes a wheel, however, which invariably will become entangled in the subject's hair. Of course, this hair cutting apparatus is intended to replace standard hair clippers and not merely to adapt them to accurately cut longer hair, as does the present invention.

U.S. Pat. No. 4,000,562 discloses an attachment directly to a vacuum source (instead of a hair clipper) to cause hair to be drawn up through the body of the attachment and permit the hair to be cut at a selected length through graduated opening means along the length of the attachment using standard household scissors. U.S. Pat. No. 4,679,322 teaches motor-driven clippers which are connected to suction devices wherein the airflow is used to pull the hair to a convenient cutting position and to efficiently evacuate the clippings. To allow adjustable spacing between the line of cut and the scalp of the subject, the patentees disclose "[S] pacers of various lengths and configurations . . . , for attachment to the mouth of the clippers."

Finally, U.S. Pat. No. 4,704,794 describes a hair clipper adapted to be connected to a vacuum source. Representative of the state of the art in such devices, the patentees provide "[I]ntake extensions of various lengths and shapes . . . , removably attached to the casing to vary the length of the uncut hair."

Therefore, in the absence of prior art means for using electric hair cutters and pneumatic removal of hair cuttings to cut, trim, or style hair of substantial length, an object of the present invention is to provide an adjustable spacer for powered hair clippers which are operated in conjunction with pneumatic means for removing hair cuttings. It is a further object of this invention to provide said adjustable spacer which is easily attached to and detached from the cutting head of the hair clippers. Another object of this invention is to provide a clipper-attachable spacer which will permit variable spacing along the width of the cutting head of the clippers such that one side edge of the cutting head will cut hair of a shorter length at the same time as the opposite side edge of the cutting head will be cutting hair of a longer length, or vice-versa, as required in tapering hair length along the side or back of the head. An overall object of this invention is to provide a method of hair cutting using the invention adjustable spacer to permit confident use in the home by an unskilled hair cutter.

Other objects of the present invention will become apparent upon reading the following specification and referring to the accompanying drawings, which form a material part of this disclosure.

SUMMARY OF THE INVENTION

The above objects are achieved by the present invention wherein a spacer element is provided for conventional powered hair clippers which operate in conjunction with pneumatic means for removing hair cuttings. The invention spacer element is formed to provide an extension means on either side of the cutting head of the hair clippers via the attachment thereto of a bracket from and through which the extension means slideably moves. The bracket includes both means of attachment to the hair clippers and means to control the degree of extension of the extension means. In one embodiment, the brackets may attach to either side of the hair clippers adjacent to the cutting head. In an alternative embodiment, the brackets may be affixed to either side of a shoe comb designed for easy attachment to and detachment from the cutting head of the hair clippers.

DESCRIPTION OF THE PREFERRED EMBODIMENT(S)

Figure 1:
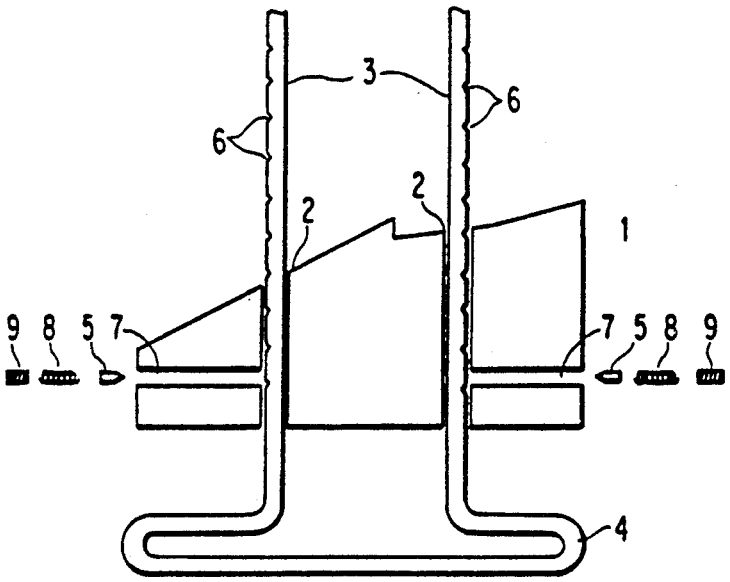
FIG. 1 is a cross-sectional, partially exploded view of one invention spacer element showing how the extension means slideably moves within the bracket and how the variable extension settings are achieved.
Figure 2:
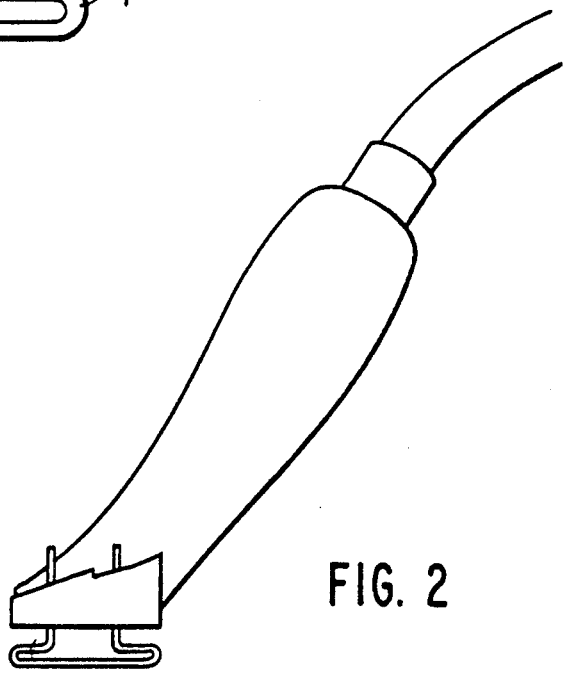
FIG. 2 is a view of the invention spacer element attached directly to either side of the hair clippers.
Figure 3:
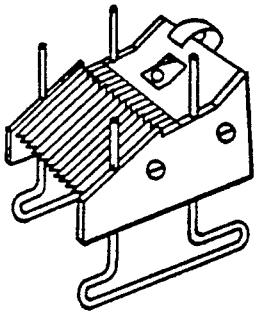
FIG. 3 is a view of the invention spacer element affixed to either side of a shoe comb which may be easily attached to and detached from the hair clippers.

Referring now more particularly to the drawings, and specifically to FIG. 1 thereof, the invention adjustable spacer for powered hair clippers operated in conjunction with pneumatic means for removing hair clippings is shown and includes mounting means, or brackets, 1 to permit mounting of the adjustable spacer directly on either exterior side of the bottom (cutting end) of the clippers, as shown in FIG. 2, or on either side of a conventional shoe comb designed to be easily attached to and detached from hair clippers, as shown in FIG. 3. Such a conventional shoe comb is taught in U.S. Pat. No. Des. 175,141, which teaching is incorporated herein by reference. Bracket 1 contains at least one vertical channel 2 through its vertical axis (from top to bottom) to permit the slideable movement of an extension means 3. Both the mounting means (or bracket) and extension means may be formed from any rigid material including, among others, metal, plastic, wood, nylon, etc. For hygiene and anti-corrosion purposes, stainless steel is the preferred material for the extension means, as it may be the only part of the adjustable spacer which directly contacts the scalp. For ease in cleaning (sterilizing) and economy, plastic is the preferred material for the mounting means.

The slideably movable extension means 3 preferably is shaped so as to conform to the shape of vertical channel 2. Inasmuch as the preferred material for extension means 3 is a round stainless steel rod, the preferred shape of the channel is circular, exhibiting a diameter just larger than the diameter of said rod. A singular extension means may be employed through multiple channels in the bracket as shown in FIG. 1, with a foot 4 shaped to provide a comfortable, smooth contact with the scalp. The extension means alternatively may be singular and pass through but a singular vertical channel in the bracket. Also, there could be provided multiple extension means passing through multiple channels in the bracket.

Adjustment of the extension means is provided by a regulating means to regulate the distance the extension means extends below the bottom of the bracket. The regulating means may be formed by any method of fixing the distance extension means 3 extends below the bottom of the bracket, whether by stops along the length of the extension means or by applying tension or other force along said length, or any other means. The preferred regulating means method is as shown in FIG. 1. A pointed tooth, or locking pin, 5 is forced against extension means 3 such that it rests in one of a series of regularly spaced notches 6 along the length of extension means 3 in a position to receive the point of said locking pin. The locking pin 5 is provided within a horizontal channel 7 through bracket 1 along a horizontal axis of said bracket which intersects vertical channel 2 and exits out a side edge of said bracket. Said locking pin is held against the extension means by a force provided by a spring 8 within said horizontal channel and the spring is held, in turn, in position against the locking pin by a screw 9. Said screw, in turn, is held in place by its alignment with threads provided along the horizontal channel. The position of the screw may be adjusted to position the spring to supply the appropriate force against the locking pin to permit the extension means to be moved to position the locking pin from notch to notch by a slightly greater force than would be supplied during use in cutting hair, such that the adjustable spacer could be adjusted by the operator's hands but not slip from the pressure applied during the cutting operation.

The powered hair clippers with which the invention adjustable spacer can be employed includes both AC and DC electric motor powered clippers adapted with a vacuum system for pneumatic removal of hair cuttings and clippers which have cutting mechanisms made operable by the flow of air through the body (i.e., the cutting head and housing) of the clippers and contacting vaned turbines or wheeled louvers causing meshed gears to turn. The latter type of clippers are of the kind marketed by Kirby vacuum manufacturer and are driven by attachment to the vacuum which also serves to pneumatically remove the hair cuttings.

From the foregoing it is seen that the invention provides an adjustable spacer element for hair clippers operated in conjunction with pneumatic means of removing hair cuttings which is uniquely simple in structure and operation, and otherwise fully accomplishes its intended objects.

Although the present invention has been described in some detail by way of illustration and example for purposes of clarity of understanding, it is understood that certain changes and modifications may be made within the spirit of the invention.

What I claim is:

1. An adjustable spacer for powered hair clippers adapted for the pneumatic removal of hair clippings comprising the degree of extension of each extension means from said brackets being determined independently by a regulating means for maintaining a desired degree of extension and each extension means terminating in a foot for contacting the scalp, wherein said clippers are comprised of a cutting head and a housing, wherein each first and second extension means for adjustably spacing said clippers relative to a subjects scalp, said first extension means being attached to one side of said clippers by a first bracket, said second extension means being attached to another side of said clipper by a second bracket, bracket compresses a first channel and one of said extension means travels through said first channel, and wherein said regulating means comprises a series of notches along one side of each extension means against which may rest a locking pin held in place by pressure provided by a spring, which, in turn, is held in place by an adjustable screw for varying said pressure, said locking pin, spring, and screw lying within a second channel through said bracket wherein said second channel perpendicularly intersects said first channel and exits out a side edge of each bracket, permitting adjusting the degree of extension of each extension means beyond the cutting head of said clippers to predetermine the length of cut hair.

2. The spacer of claim 1 wherein said brackets are attached to either side of a shoe comb adapted for easy attachment to and detachment from said hair clippers.

3. The spacer of claim 1 wherein said brackets and said first and second extension means are formed from a rigid material.

4. The spacer of claim 3 wherein said rigid material is metal.

5. The spacer of claim 3 wherein said rigid material is plastic.

6. The spacer of claim 3 wherein said rigid material is wood.

7. The spacer of claim 3 wherein said rigid material is nylon.

8. The spacer of claim 1 wherein each extension means is shaped to conform to said first channel.

9. The spacer of claim 1 wherein said powered hair clippers are made operable by said pneumatic adaptation.

* * * * *